US005508146A

United States Patent [19]

Weber et al.

[11] Patent Number: 5,508,146

[45] **Date of Patent: *Apr. 16, 1996**

[54] IMAGING ELEMENT OVERCOAT FOR REDUCTIVE LASER-IMAGING

[75] Inventors: Sharon W. Weber; Lee W. Tutt; Mitchell S. Burberry, all of Webster; Charles D. DeBoer, Rochester, all of N.Y.

[73] Assignee: Eastman Kodak Company, Rochester, N.Y.

[ * ] Notice: The term of this patent shall not extend beyond the expiration date of Pat. No. 5,506,093.

[21] Appl. No.: 380,539

[22] Filed: Jan. 30, 1995

Related U.S. Application Data

[63] Continuation-in-part of Ser. No. 205,535, Mar. 4, 1994.

[51] Int. Cl.[6] ..... G03C 5/16

[52] U.S. Cl. ..... 430/350; 430/341; 430/332; 430/336; 430/523; 430/529; 430/944; 430/945

[58] Field of Search ..... 430/341, 944, 430/336, 332, 936, 523, 529, 350, 945

[56] References Cited

U.S. PATENT DOCUMENTS

| | | | |
|---|---|---|---|
| 3,628,953 | 12/1971 | Brinckman . | |
| 4,247,625 | 1/1981 | Fletcher et al. | 430/336 |
| 4,259,424 | 3/1981 | Endo et al. | 430/619 |
| 4,288,531 | 9/1981 | Adin et al. | 430/338 |
| 4,333,998 | 6/1982 | Leszyk | 430/12 |
| 4,410,623 | 10/1983 | DoMinh et al. | 430/341 |
| 4,612,279 | 9/1986 | Steklenski et al. | 430/523 |
| 4,948,707 | 8/1990 | Johnson et al. | 430/330 |

*Primary Examiner*—Thorl Chea
*Attorney, Agent, or Firm*—Harold E. Cole

[57] ABSTRACT

This invention relates to an imaging element for reductive laser-imaging comprising a support having thereon an imaging layer comprising:

a) a reducible Co(III) ammine complex, b) a source of phthalaldehyde, and c) a reducing agent, the imaging layer having an infrared-absorbing material associated therewith in the amount of about 0.001 to about 0.5 g/m$^2$ of element, and wherein the imaging element has a Lewis acid-containing overcoat layer thereon.

13 Claims, No Drawings

IMAGING ELEMENT OVERCOAT FOR REDUCTIVE LASER-IMAGING

CROSS REFERENCE TO RELATED APPLICATIONS

This application is a continuation-in-part of U.S. Ser. No. 08/205,535, of Weber et al., filed Mar. 4, 1994.

This invention relates to the use of an overcoat for an imaging element for a reductive laser-imaging system which is useful for printing monochrome images developed by simple heating in the absence of chemical developing agents.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

U.S. Pat. No. 4,247,625 discloses an imaging element employing a reaction product of a cobalt complex and an aromatic dialdehyde which reacts with ammines generated in response to activating radiation. The activating radiation is used to excite a photo-activated photoreductant which, after activation, reduces cobaltic to cobaltous ammine complex salt. The photoreductant materials generally absorb in the blue and UV portions of the spectrum. The resulting films are therefore of low contrast in the blue and UV portion of the spectrum. In addition, the exposing device must emit in the blue and UV portions of the spectrum.

U.S. Pat. No. 4,288,531 discloses the used acidic overcoats on an imaging element. However, the particular imaging elements of the invention are not disclosed.

U.S. Ser. No. 08/380,479 of Kaplan et al., filed Jan. 30, 1995 and entitled, "Imaging Element For Reductive Laser-Imaging" discloses an imaging element that can be exposed by a diode laser source that can be developed by thermal energy alone to provide images of high resolution free from flare. However, a problem has developed with these images in that they suffer from post-processing "print up" where the minimum optical density (D-min) in the clear (unexposed) areas, which represents a measure of the absence of dye, gradually changes to higher (undesirable) values.

It would be desirable to provide an imaging element that can be exposed by a diode laser source and that can be developed by thermal energy alone to provide images of high resolution free from flare. It would also be desirable to provide such an element which would reduce or eliminate the post-processing "print-up" problem described above.

These and other objects are achieved in accordance with this invention which relates to an imaging element for reductive laser-imaging comprising a support having thereon an imaging layer comprising:

a) a reducible Co(III) ammine complex, b) a source of phthalaldehyde, and c) a reducing agent, the imaging layer having an infrared-absorbing material associated therewith in the amount of about 0.001 to about 0.5 g/m$^2$ of element, and wherein the imaging element has a Lewis acid-containing overcoat layer thereon. In a preferred embodiment of the invention, a binder is also employed in the imaging layer.

Cobalt(III) ammine complexes useful in the invention generally have at least two ammonia ligands and include the following:

$Co(III)(NH_3)_6(CF_3—CO_2)_3$ (cobalt hexaammine trifluoroacetate)

$Co(III)(NH_3)_4(H_2O)_2(Cl^-)_3$ $[Co(III)(NH_3)_3(N_3)_3]$ $[Co(III)(NH_3)_5(C_2O_4)]^{1+}X^n$ $[Co(III)(NH_3)_4(C_2O_4)]^{1+}X^n$ $[Co(III)(NH_3)_2(C_2O_4)]^{1+}X^n$ $[Co(III)(NH_3)_3(H_2O)(C_2O_4)]^{1+}X^n$ $[Co(III)(NH_3)_4(NO_2)(N_2H_4)]^{2+}X^n$ $[Co(III)(NH_3)_3(H_2O)_3]^{3+}X^n$ $[Co(III)(NH_3)_3(N_3)_3]$ $[Co(III)(NH_3)_3(Cl_3)]$ wherein X is a suitable anion and n is the number of atoms necessary to satisfy charge neutralization.

The above cobalt ammine complexes may be employed in amounts ranging from about 0.1 g/m$^2$ to about 5 g/m$^2$ of the imaging layer.

A source of phthalaldehyde includes phthalaldehyde:

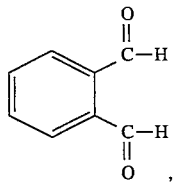

as well as adducts of phthalaldehyde as disclosed in columns 3–9 of U.S. Pat. No. 4,410,623, the disclosure of which is hereby incorporated by reference.

A preferred class of phthalaldehyde adducts include the following:

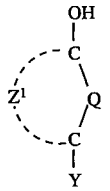

wherein $Z^1$ is the number of atoms necessary to complete two, or three carbocyclic or heterocyclic rings of from 9 to 13 nuclear atoms;

Q is O,

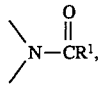

$>NSO_2R^2$, or S;

Y is —OH, —$OR^5$, —$CHR^3R^4$,

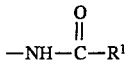

or —$NR^6R^7$;

$R^1$ is

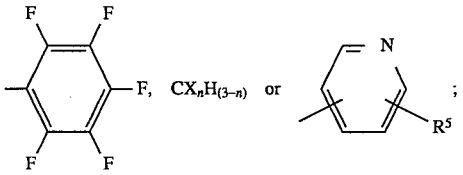

$R^2$ is alkyl or alkaryl of from 1 to 11 carbon atoms, for example, methyl, ethyl, propyl, isopropyl, p-methylphenylene, p-ethylphenylene and the like, the terms alkyl and alkaryl being understood to include those that are substituted in the alkyl portion, for example, p-(1-hydroxyethyl)phenylene;

$R^2$ further includes aryl or aralkyl of from 6 to 11 carbon atoms, for example, phenyl, naphthyl, benzyl, and the like, the term "aryl" being understood to include, in this context, substituted aryl, for example, aryl having halogen, nitro, alkyl, alkoxy, α-hydroxyalkyl, dialkylamino and/or

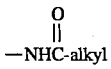

substituents. (In some examples herein, the convention followed for the substituents on the carbo- or heterocyclic rings is that hydrogen substituents are not shown since they are obvious.)

$R^3$ and $R^4$ are the same or different and are each hydrogen, —$SO_3CH_3$, $NO_2$, or alkyl of from 1 to 5 carbon atoms, for example, methyl, ethyl, propyl, isopropyl and the like;

$R^5$ is alkyl of from 1 to 5 carbon atoms, for example, methyl, ethyl, propyl, isopropyl and the like; or is

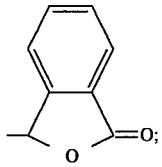

and $R^6$ and $R^7$ are individually H or $SO_2R^2$, or together comprise the atoms necessary to complete a ring having the structure

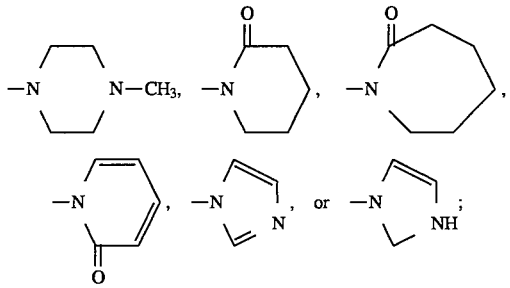

X is halogen, such as chlorine, bromine, iodine, and fluorine; and n is 1, 2, or 3.

Specific adducts of phthalaldehyde are:

Compound A

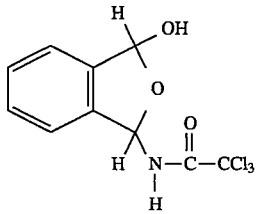

Compound B

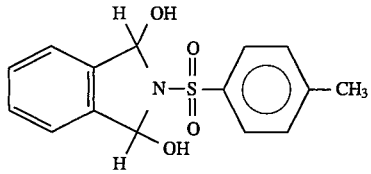

The above phthalaldehyde or adducts thereof may be employed in amounts ranging from about 0.1 g/m$^2$ to about 10 g/m$^2$ of the imaging layer.

Examples of suitable reducing agents useful in the invention include the following:

dimethylhydantoin 3,4-dihydroxy-benzonitrile 1-naphthyl disulfide thioctic acid 10-diazoanthrone or any of the materials listed in Table II, columns 4–5 of U.S. Pat. No. 4,294,912, the disclosure of which is hereby incorporated by reference.

The above reducing agents may be employed in amounts ranging from about 0.1 g/m$^2$ to about 5 g/m$^2$ of the imaging layer.

Upon exposure of the imaging element to a laser beam, Co(III) is reduced to Co(II), and ammonia is produced during this reduction of the cobaltammine complex which then interacts with the phthalaldehyde to produce an intense black dye in the imaged areas. The thermal images obtained with such a medium are free of flare and exhibit high resolution and contrast.

A process of forming an image according to the invention comprises imagewise-heating, by means of a laser, an imaging element for reductive laser-imaging comprising a support having thereon an imaging layer comprising:

a) a reducible Co(III) ammine complex, b) a source of phthalaldehyde, and c) a reducing agent, the imaging layer having an infrared-absorbing material associated therewith, and wherein the imaging element has a Lewis acid-containing overcoat layer thereon, and then thermally developing the element using heat. In a preferred embodiment of the invention, the heating step comprises heating with a hot block or roller at a temperature of from about 90° C. to about 200° C. for a period of at least about 2 seconds.

The overcoat layer of the invention may comprise any compound which can act as a Lewis acid, such as any carboxylic acid, e.g., salicylic acid, acetylsalicylic acid, acrylic acid, phthalic acid, crotonic acid, benzoic acid, etc. Further, the acidic overcoat layer need not be directly in contact with the imaging layer. A barrier or timing layer may be interposed between these layers which allows intermixing to occur only upon thermal development.

The binders which may be employed in the imaging layer include materials such as cellulose acetate propionate, cellulose acetate butyrate, poly(vinyl butyral), nitrocellulose, poly(styrene-co-butyl acrylate), polycarbonates such as Bisphenol A polycarbonate, poly(styrene-co-vinylphenol) and polyesters. While any amount of binder may be employed in the layer which is effective for the intended purpose, good results have been obtained using amounts of about 0.1 to about 5 g/m$^2$.

To obtain the laser-induced image of the invention, diode lasers are preferably employed since they offer substantial advantages in terms of small size, low cost, stability, reliability, ruggedness, and ease of modulation. In practice, before any laser can be used to heat an imaging element, the element must contain a laser light-absorbing material, such as carbon black, titanium dioxide or cyanine laser light-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser light-absorbing material can be employed at any concentration effective for the intended purpose. In general, good results have been obtained when the laser light-absorbing material is employed at 0.05 to about 0.5 g/m$^2$ within the imaging layer itself or in an adjacent layer. The laser radiation is then absorbed into the imaging layer and converted to heat by a molecular process known as internal conversion.

Lasers which can be used in the invention are available commercially. There can be employed, for example, Laser Model SDL-2420-H2 from Spectra Diode Labs, or Laser Model SLD 304 V/W from Sony Corp.

Any material can be used as the support for the imaging element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The following examples are provided to illustrate the invention.

EXAMPLE 1

The following mixture was prepared and stirred until dissolved:

26.75 g cobalt hexaammine trifluoroacetate 83.25 g Compound A above 33.25 g dimethylhydantoin reducing agent 0.25 g IR dye (see below)

144 g cellulose acetate propionate (20 s viscosity)

enough acetone to make 1 liter total volume.

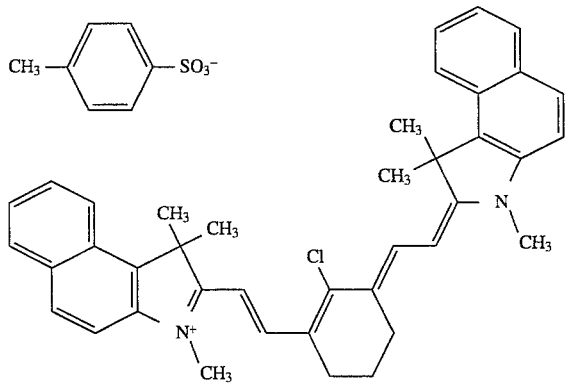

IR absorbing dye

The solution was coated at 43 ml/m$^2$ on a 100 μm polyester support. After drying, the film was exposed to a diode laser beam on an apparatus described in U.S. Pat. No. 5,168,288. The exposure level was 200 mJ/cm$^2$ at 830 nm, with a 20 μm spot and a 10 μm line spacing. After exposure, the film was heated on a hot block held at 120° C. for thermal development. Each sample film was then placed under fluorescent light and the yellow D-min monitored as a function of time.

Five test runs were made to show the effectiveness of an acid-containing overcoat in relation to the deterioration of yellow D-min values over time. The following results were obtained:

TABLE 1

| | Yellow D-min After | | | | | | |
|---|---|---|---|---|---|---|---|
| Over-coat # | t = 0 hr | 24 hrs | 48 hrs | 3 days | 4 days | 9 days | 21 days |
| none | 0.06 | 0.13 | 0.13 | 0.13 | 0.13 | 0.17 | 0.17 |
| 1 | 0.06 | 0.15 | 0.15 | 0.15 | 0.15 | 0.15 | 0.15 |
| 2 | 0.06 | 0.08 | 0.08 | 0.08 | 0.08 | 0.08 | 0.08 |
| 3 | 0.06 | | | 0.08 | | | |
| 4 | 0.06 | 0.09 | 0.09 | 0.09 | 0.09 | 0.09 | 0.09 |

#1 this is a coating of Butvar 76 ® poly(vinyl butyral) (DuPont Corp.) from methanol at 1.46 g/m$^2$;

TABLE 1-continued

| Overcoat # | Yellow D-min After t = 0 hr | 24 hrs | 48 hrs | 3 days | 4 days | 9 days | 21 days |
|---|---|---|---|---|---|---|---|

#2 same as #1 but contained an acrylic copolymer (30:70 mole % butyl acrylate: acrylic acid copolymer) from ethanol at 0.08 g/m$^2$;
#3 same as #1 but contained poly(acrylic acid) at 0.09 g/m$^2$;
#4 the imaging layer was first overcoated with Butvar 76 ® at 0.11 g/m$^2$ which was then overcoated with overcoat #2 in a separate layer at 0.08 g/m$^2$, both layers coated from ethanol.

The above data show a significant improvement in the stabilization of the D-min values when an acidic material was included in the overcoat. Also, the acidic layer need not be directly in contact with the imaging layer; a barrier or timing layer may be interposed between both layers as shown in #4.

EXAMPLE 2

Additional experiments were performed to show the effect obtained with other acids.

An imaging element was prepared as in Example 1 and overcoated with the materials indicated in Table 2 below:

TABLE 2

| Overcoat # | Yellow D-min After t = 0 hr | 24 hrs | 1 week |
|---|---|---|---|
| none | 0.05 | 0.55 | 1.07 |
| 1 | 0.05 | 0.45 | 1.27 |
| 2 | 0.05 | 0.11 | 0.18 |
| 3 | 0.05 | 0.12 | 0.11 |
| 4 | 0.05 | 0.10 | 0.10 |

#1 this is a coating of Butvar 76 ® poly(vinyl butyral) (DuPont Corp.) from methanol at 1.46 g/m$^2$;
#2 same as #1 but contained benzoic acid at 0.08 g/m$^2$;
#3 same as coating #2, except that salicylic acid was used instead of benzoic acid;
#4 same as coating #2, except that acetylsalicylic acid was used at a laydown of 0.09 g/m$^2$, instead of benzoic acid.

The above data clearly show the advantages realized when various carboxylic acids are used in the overcoat layer of the present invention.

The invention has been described in detail with particular reference to preferred embodiments thereof, but it will be understood that variations and modifications can be effected within the spirit and scope of the invention.

What is claimed is:

1. A process of forming an image comprising imagewise-exposing, by means of a laser, an imaging element for reductive laser-imaging comprising a support having thereon an imaging layer comprising:

a) a reducible Co(III) ammine complex, b) a source of phthalaldehyde, and c) a reducing agent, said imaging layer having an infrared-absorbing material associated therewith, and wherein said imaging element has a Lewis acid-containing overcoat layer thereon, and then thermally developing said element using heat.

2. The process of claim 1 where said heating step is performed at a temperature of from about 90° C. to about 200° C. for a period of at least about 2 seconds.

3. The process of claim 1 wherein said laser is an infared diode laser.

4. The process of claim 1 wherein a binder is present in said imaging layer.

5. The process of claim 4 wherein said binder is cellulose acetate propionate.

6. The process of claim 1 wherein said reducible Co(III) ammine complex has at least two ammonia ligands.

7. The process of claim 6 wherein said reducible Co(III) ammine complex is $Co(III)(NH_3)_6(CF_3\text{-}CO_2)_3$ $Co(III)(NH_3)_4(H_2O)_2(Cl^-)_3$ $[Co(III)(NH_3)_3(N_3)_3]$ $[Co(III)(NH_3)_5(C_2O_4)]^{1+}X^n$ $[Co(III)(NH_3)_4(C_2O_4)]^{1+}X^n$ $[Co(III)(NH_3)_2(C_2O_4)]^{1+}X^n$ $[Co(III)(NH_3)_3(H_2O)(C_2O_4)]^{1+}X^n$ $[Co(III)(NH_3)_4(NO_2)(N_2H_4)]^{2+}X^n$ $[Co(III)(NH_3)_3(H_2O)_3]^{3+}X^n$ $[Co(III)(NH_3)_3(N_3)_3]$ $[Co(III)(NH_3)_3(Cl_3)]$ wherein X is a suitable anion and n is the number of atoms necessary to satisfy charge neutralization.

8. The process of claim 1 wherein said reducible Co(III) ammine complex is cobalt hexaammine trifluoroacetate.

9. The process of claim 1 wherein said reducing agent is dimethylhydantoin.

10. The process of claim 1 wherein said infrared-absorbing material is a dye.

11. The process of claim 1 wherein said infrared-absorbing material is located in a layer adjacent to said imaging layer.

12. The process of claim 1 wherein said Lewis acid is salicylic acid, acetylsalicylic acid, acrylic acid, phthalic acid, crotonic acid or benzoic acid.

13. The process of claim 1 wherein a barrier or timing layer is present between said imaging layer and said overcoat layer.

* * * * *